US012408774B2

(12) United States Patent
Chon et al.

(10) Patent No.: US 12,408,774 B2
(45) Date of Patent: Sep. 9, 2025

(54) ADJUSTABLE COMFORTER

(71) Applicant: Coop Home Goods, LLC, Pico Rivera, CA (US)

(72) Inventors: Kevin Chon, Pico Rivera, CA (US); Jin Chon, Pico Rivera, CA (US); Debbie Liu, Pico Rivera, CA (US)

(73) Assignee: COOP HOME GOODS, LLC, Pico Rivera, CA (US)

( * ) Notice: Subject to any disclaimer, the term of this patent is extended or adjusted under 35 U.S.C. 154(b) by 330 days.

(21) Appl. No.: 17/719,824

(22) Filed: Apr. 13, 2022

(65) Prior Publication Data

US 2023/0329461 A1 Oct. 19, 2023

(51) Int. Cl.
*A47G 9/02* (2006.01)

(52) U.S. Cl.
CPC ..... *A47G 9/023* (2013.01)

(58) Field of Classification Search
CPC ..... A47G 9/023; A47G 9/0207; A47G 9/04; A47G 9/0223; A47G 9/02; A47G 9/0261; A47G 2009/0269; A47G 9/0238; A47G 9/0246; A47G 2009/004; A47G 2009/0276; A47G 2200/106; A47G 2200/22; A47G 9/0284; A47G 9/062; A47G 9/064; A47G 9/08; A47G 9/086
USPC ... 5/486, 502, 482, 494, 495, 496, 500, 786, 5/782
See application file for complete search history.

(56) References Cited

U.S. PATENT DOCUMENTS

| | | | | |
|---|---|---|---|---|
| 3,331,088 | A * | 7/1967 | Marquette | A47G 9/023 5/486 |
| 6,243,896 | B1 * | 6/2001 | Osuna | A47G 9/0261 5/482 |
| 10,154,743 | B1 * | 12/2018 | Ferguson | A47G 9/0223 |
| 2009/0151072 | A1 * | 6/2009 | Jones, III | A47G 9/0246 5/486 |
| 2015/0196146 | A1 * | 7/2015 | Liddick | A47G 9/02 5/486 |
| 2018/0317674 | A1 * | 11/2018 | Richard | A47G 9/0223 |
| 2019/0099019 | A1 * | 4/2019 | Heiman | A47G 9/0261 |
| 2020/0260885 | A1 * | 8/2020 | Stewart | A47G 9/0261 |
| 2020/0315378 | A1 * | 10/2020 | Cooley | B32B 7/02 |

OTHER PUBLICATIONS

"Duvet." Dicitionary.com, Date: Aug. 31, 2018, www.dictionary.com/browse/duvet.*
"Button." LanGeek Dictionary, Picture Dictionary, https://dictionary.langeek.co/en/word/25770?entry=button.*

* cited by examiner

*Primary Examiner* — Madison Emanski
(74) *Attorney, Agent, or Firm* — Carlson, Gaskey & Olds, P.C.

(57) ABSTRACT

An adjustable comforter includes a base comforter having a top fabric layer attached to a bottom fabric layer. A plurality of microfiber filled cavities are formed between the top and bottom fabric layers. Buttons are attached to the bottom fabric layer and provide for attachment of at least one accessory panel to the base comforter to adjust provided warmth.

20 Claims, 5 Drawing Sheets

ADJUSTABLE COMFORTER

BACKGROUND

A comforter is placed on a bed to provide warmth to the sleeping occupants. Typical comforters are of a fixed thickness and provide a fixed amount of warmth. Many people experience warmth differently for different parts of the body. For example, a person's feet may feel colder or warmer than other upper parts of the body. However, the comforter provides only a fixed level of warmth and therefore blankets are added or parts of the body are left uncovered to adjust a comfort level for a sleeping occupant. Moreover, two people that share a comforter often have different preferences. One person may prefer more warmth where another may prefer minimal covering.

The background description provided herein is for the purpose of generally presenting a context of this disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

An adjustable comforter according to one disclosed example embodiment includes, among other possible things, a base comforter having a top fabric sheet attached to a bottom fabric sheet and a plurality of microfiber filled cavities disposed therebetween. A plurality of spaced apart fasteners are disposed on the bottom fabric sheet to provide for attachment of accessory panels for adjusting warmth. In one disclosed embodiment, the fasteners are buttons that are attached to the base comforter with stitches. The accessory panel includes holes for receiving the buttons to secure it to the base comforter. The warmth provided by the adjustable comforter is tailored for different seasons and people by attaching panels to different locations of the base comforter as desired.

Although the different examples have the specific components shown in the illustrations, embodiments of this disclosure are not limited to those particular combinations. It is possible to use some of the components or features from one of the examples in combination with features or components from another one of the examples.

These and other features disclosed herein can be best understood from the following specification and drawings, the following of which is a brief description.

DETAILED DESCRIPTION

Figure 2:
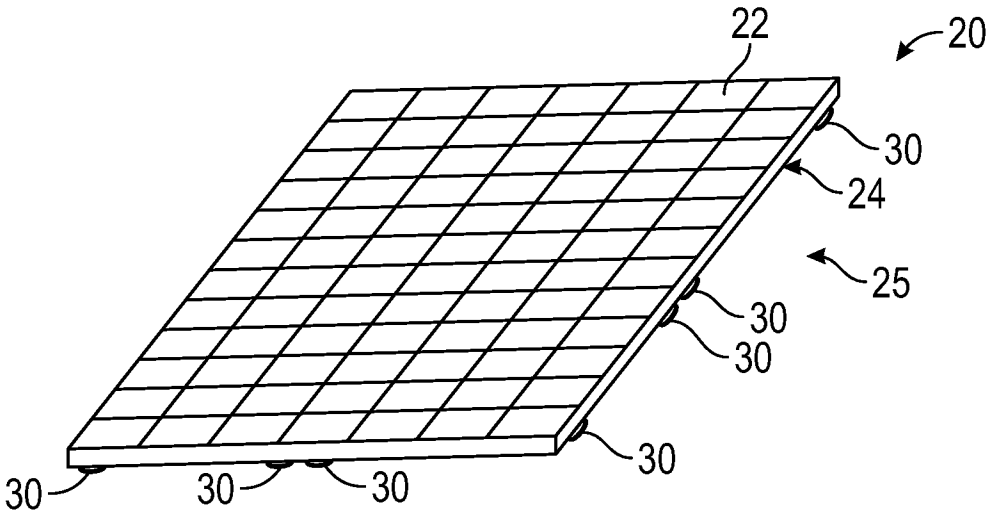
FIG. 2 is schematic view of a quarter sized accessory layers.
Figure 2:
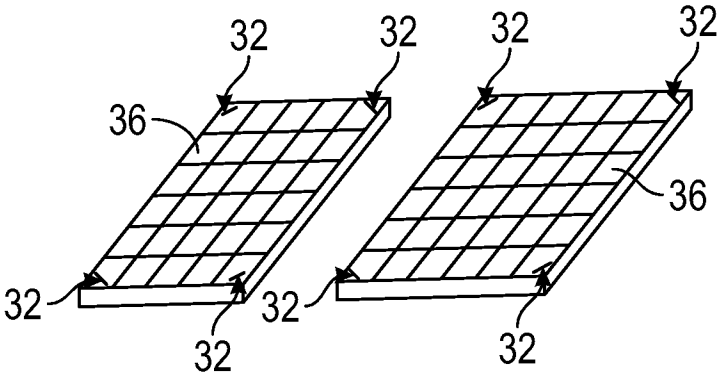
Figure 1:
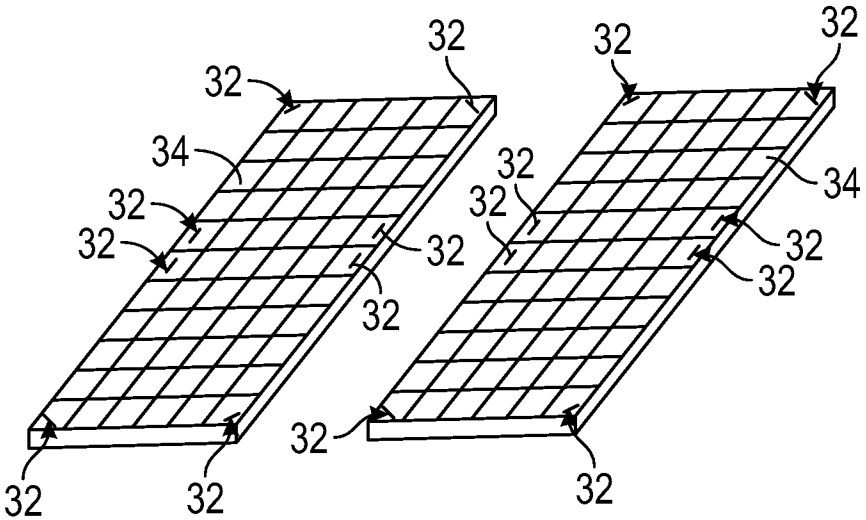
FIG. 1 is a schematic view of a disclosed adjustable comforter assembly embodiment.

Referring to FIGS. 1 and 2, an adjustable comforter 25 is schematically shown and includes base comforter 20 to which an accessory panel 34 or quarter segment 36 may be attached to locally adjust warmth. The base comforter 20 is formed with microfiber fill disposed between a top fabric layer 22 and a bottom fabric layer 24. The accessory panel 34 and the quarter segment 36 may also be provided as a microfiber filled panels or segments.

The bottom fabric layer 24 includes a plurality of spaced apart fasteners 30. In this disclosed example, the fasteners are buttons 30 that are secured at intervals about periphery of the bottom fabric layer 24 of the base comforter 20. The accessory panel 34 is ½ the width of the base comforter 20. The quarter segment 36 is ¼ the size of the base comforter 20. Each of the accessory panels 34 and quarter segments 36 have button holes 32 that align with the buttons 30 of the base comforter 20. The accessory panels 34 and quarter segments 36 may be attached to the base comforter 20 in any combination where the button holes 32 align the buttons 30. It should be appreciated, that the quarter segments 36 are accessory panels of a different size and referred to as segments for clarity purposes in this disclosure. Moreover, although accessory panels of ½ and ¼ the size of the base comforter 20 are disclosed and described by way of example, other sizes of attachable panels could be utilized within the contemplation and scope of this disclosure.

In one disclosed example, the comforter assembly 25 is sized for a standard king size bed, however, the specific size may be modified to fit queen, full, California King and or any other size bed. Moreover, the comforter assembly 25 may be provided in various sizes that can be used on similar sized beds. For example, one comforter assembly size may be fabricated for use with both full and queen size beds, another comforter size may be fabricated for use with King and California size King beds. Additionally, the comforter assembly 25 could be fabricated for use with twin and child sized beds. Moreover, other sizes and shapes of the example comforter assembly 25 are within the contemplation and scope of this disclosure.

The accessory panels 34 and quarter segments 36 provide for adjustment of warmth to fine tune the comforter assembly 25 to personal preferences and seasonal temperature changes. One half size accessory panel 34 can be attached to one side of the base comforter 20 to provide more warmth on one side while providing cooler sleeping conditions on the other side. Additionally, the quarter sized segments 36 could be attached at the bottom of one side to provide warmer feet and cooler top, or reversed and attached near the top to provide increased top warmth and cooler conditions at a person's feet. Moreover, the accessory panels 34 and segments 36 may be attached in many other combinations for tailoring of warmth to many different conditions and preferences.

Moreover, either of the accessory panels 34 and the quarter segments 36 may be provided as a weighted panel to provide a secure calm feeling. Weighted panels can provide a grounding feeling that may improve sleep quality and relieve stress and anxiety. Either size of the accessory panels 34 and quarter segments 36 may be formed as a weighted panel and include button holes for attachment. Weighted panels would include additional weight generating filling, or different microfiber filling to provide the desired weight. In one disclosed embodiment, the weighted panels are filled with microfiber fill and glass beads (not shown). The glass beads are added to provide the additional weigh. Alternatively, the fabric utilized to form the weighted panel may be of an increased weight to provide the desired weighted feel. The weight of the panels may be tailored to provide a desired overall weight for each panel and/or segment. As appreciated, any configuration known for producing a weighted panel is within the contemplation and scope of this disclosure.

Figure 4:
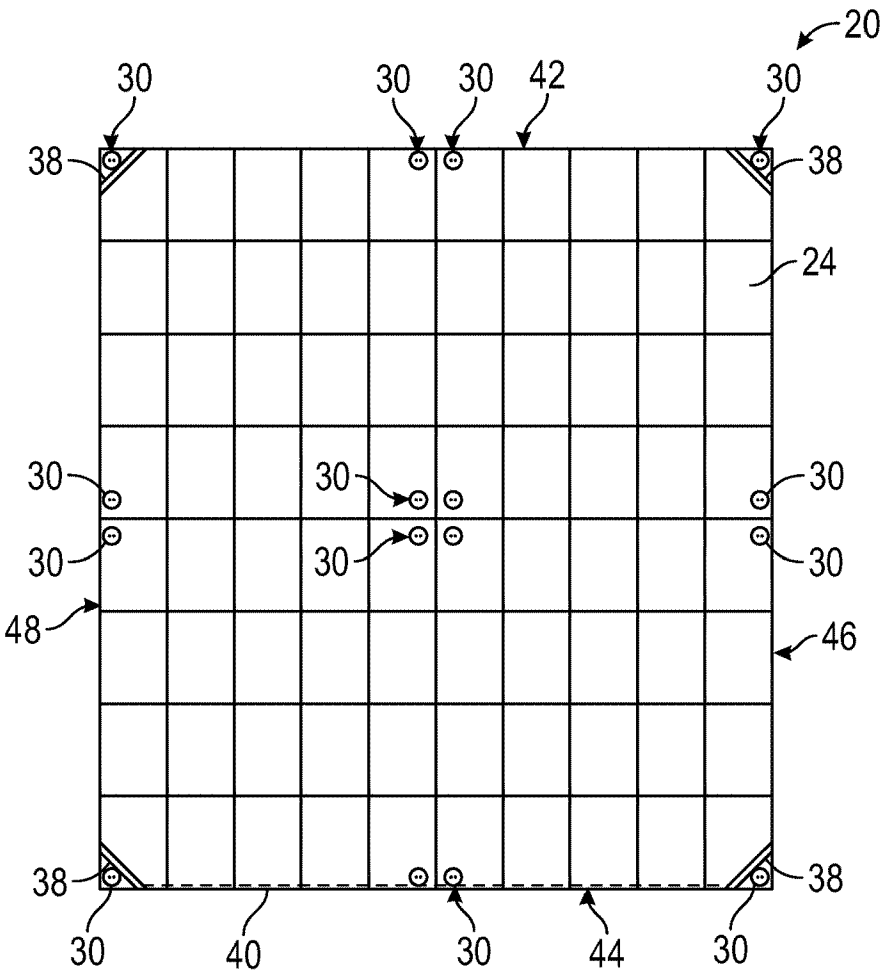
FIG. 4 is a bottom view of the bottom side of the example base comforter.
Figure 3:
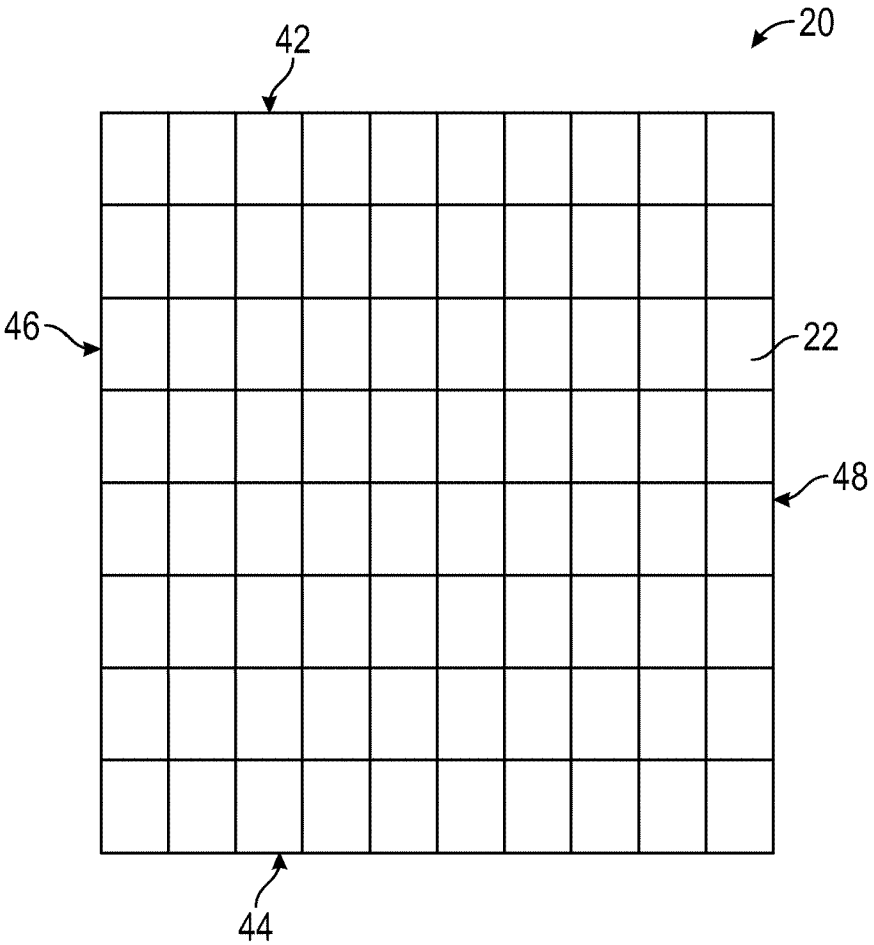
FIG. 3 is a top view of the top side of an example base comforter.

Referring to FIGS. 3 and 4 with continued reference to FIGS. 1 and 2, The base comforter 20 includes the top fabric layer 22 and the bottom fabric layer 24 separated by a spacing that defines cavities 26 for the microfiber filling 28. The top fabric layer 22 is void of any fasteners to provide an aesthetically pleasing uninterrupted side. The bottom fabric layer 24 includes the buttons 30 that are secured at intervals about periphery and across a mid-section. The buttons 30 are secured to the bottom fabric layer 24 by stitching that may extend through top fabric layer 22. However, the button 30 is only disposed on the bottom fabric layer 24.

The base comforter 20 includes a top edge 42, bottom edge 44 and side edges 46, 48. An opening 40 is provided along the bottom edge 44 to enable filling of cavities with the microfiber filing. The opening 40 may be closeable with a fastener such as a zipper, or other known closeable fastener. The opening 40 may also be sewn through to close the bottom edge once filling of the cavities with microfiber filing is completed.

Figure 5:
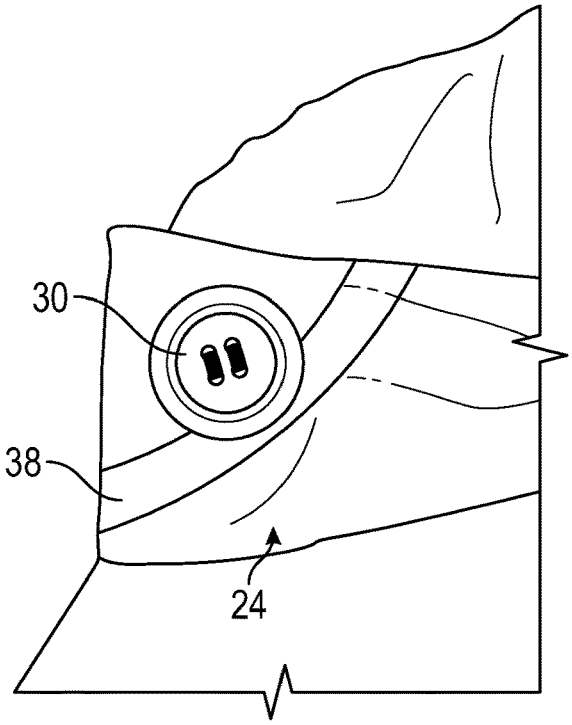
FIG. 5 is a schematic view of an example fastener attached to the bottom fabric layer of the base comforter.

Referring to FIG. 5 with continued reference to FIGS. 3 and 4, a button 30 is secured at each corner along with a loop 38. The loop 38 may be utilized to secure the base comforter 20 within a Duvet or other cover. The remaining buttons 30 are disposed down the center and along the edges 42, 44, 46 and 48 to provide for different attachment locations and combinations of the accessory comforter panel 34 and segment 36. In one disclosed embodiment, buttons 30 are provided at each corner and along the center at a midway point between the top edge 42 and the bottom edge 44. Buttons 30 are also provided at middle portion between the side edges 46, 48. Each button 30 is secured by way of stiches to the bottom fabric layer 24 such that the buttons 30 are not visible along the top fabric layer 22. It should be appreciated that although the buttons 30 are not visible, some of the stitching used to secure each button 30 may be visible through the top fabric layer 22.

In one disclosed embodiment. 16 buttons are disposed at different locations along the bottom sheet 24. Other button locations could be utilized and/or added, and the current locations adjusted to provide for additional attachment options. Moreover, although buttons 30 are disclosed by way of example, other individually located fasteners that are spaced apart around the comforter assembly 25, such as snaps, loops and ties for example could also be utilized and are within the scope and contemplation of this disclosure.

The size of the example buttons 30 are approximately 0.875 inches in diameter and are made of wood. As appreciated other sizes and materials could be utilized for form the example buttons and remain within the scope and contemplation of this disclosure. The size of the buttons 30 are provided to assure securement while not being intrusive to sleeping users.

Figure 6A:
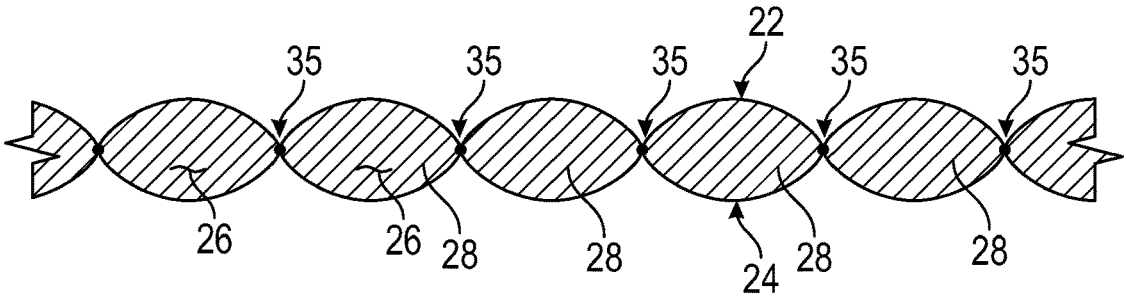
FIG. 6A is a schematic view of microfiber filled cavities of a portion of the base comforter.

Referring to FIG. 6A with continued reference to FIGS. 3 and 4, the base comforter 20 includes the cavities 26 formed by sewn through stitching 35 and filled with the microfiber filing 28. The accessory panels 34 and quarter segments 36 may be constructed with same sewn through stitch 35 construction to form the cavies 26. In one disclosed example, stiches 35 are utilized to form the cavities 26 such that the microfiber cavities 26 are the same and/or similar to the construction of the base comforter 20. The cavities 26 maintain the microfiber filling 28 in a substantially uniform amount across the base comforter 20 and the panels 34 and segments 36. The example microfiber filing 28 is a 100% polyester material that may provide a down-like feel. The microfiber filling 28 may be of a hypoallergenic material. As appreciated, other fill materials could be utilized within the contemplation and scope of this disclosure.

Figure 6B:
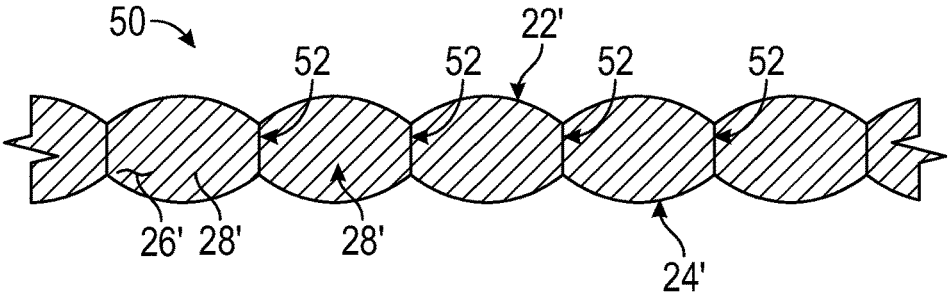
FIG. 6B is a schematic view of a baffle box configuration of a portion of the base comforter.

Referring to FIG. 6B, the cavities 26 may be formed as a baffle box construction 50 with an additional strip 52 secured between the top fabric layer 22 and the bottom fabric layer 24. The strip 52 is attached transverse to the both the top fabric layer 22 and the bottom fabric layer 24. The cavities 26 maintain the microfiber filling 28 in a substantially uniform orientation throughout the base comforter 20.

In one disclosed example, the base comforter 20 utilizes the baffle box construction 50 while the accessory panels 34 and quarter segments 36 utilizes sewn through stitching 35. As appreciated, other combinations of baffle box construction and sewn through stitching 35 could be utilized and are within the contemplation of this disclosure.

As should be appreciated, any form of construction that provides for the distribution of the microfiber filling 28 could be utilized for form the base comforter 20, the accessory panels 34 and the quarter segments 36 and remain within the scope and contemplation of this disclosure.

Figure 7:
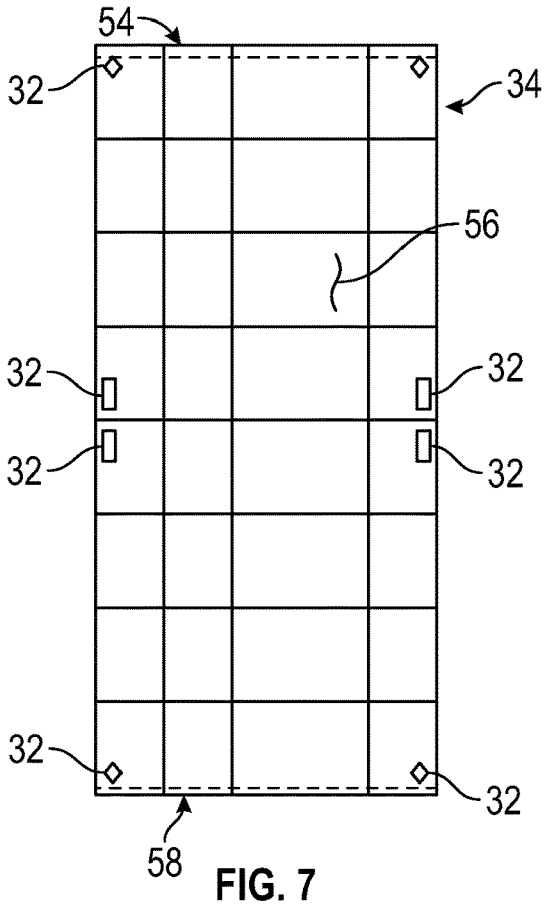
FIG. 7 is a top view of an example half sized accessory panel.
Figure 8:
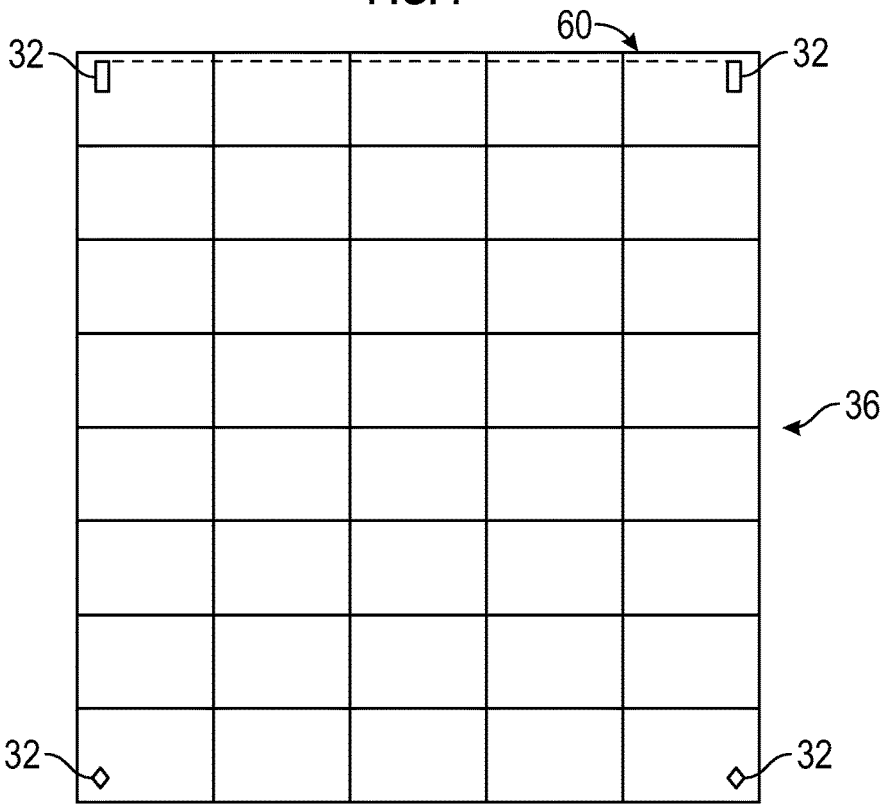
FIG. 8 is a top view of an example quarter sized segment.

Referring to FIGS. 7 and 8 with continued reference to FIGS. 3 and 4, the accessory panel 34 includes an opening 58 along a bottom edge and an opening 54 along a top edge to facilitate filling. The quarter segment 36 includes a top opening 60 for filling. As appreciated, it is within the contemplation of this disclosure that an opening can be provided on any side, or combination of sides including both top and bottom sides of the accessory panel 34 and quarter segments 36. The openings 54, 58 and 60 can be closed by a zipper, stitching or any other closeable fastener once filling is complete.

Figure 9:
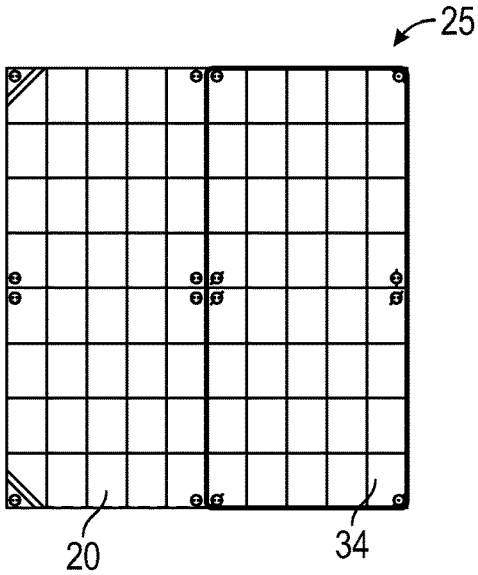
FIG. 9 is a plan view of a bottom side of the adjustable comforter assembly with a half sized accessory panel attached to the base comforter.
Figure 10:
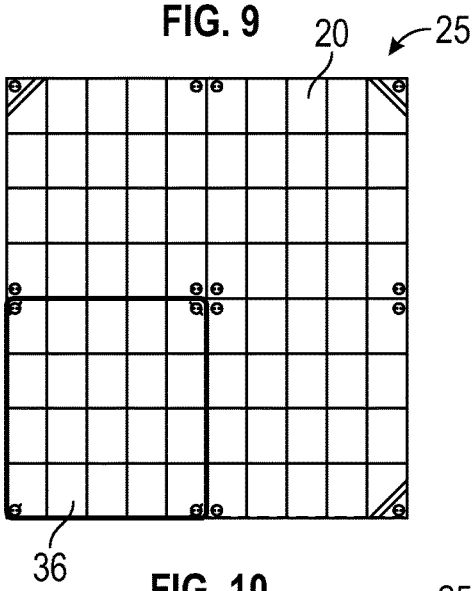
FIG. 10 is a plan view of a bottom of the adjustable comforter assembly with a quarter sized quarter segment attached to the base comforter.
Figure 11:
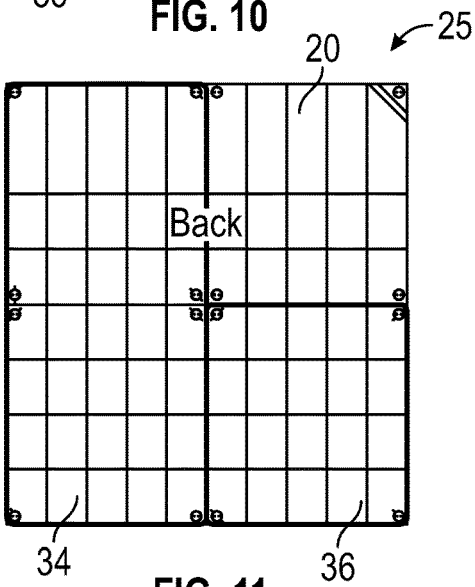
FIG. 11 is a plan view of a bottom of the adjustable comforter assembly with both a half sized accessory panel and a quarter sized quarter segment attached to the base comforter.

Referring to FIGS. 9, 10 and 11, a possible configurations of the adjustable comforter assembly 25 are schematically shown by way of example. In FIG. 9, a single ½ sized accessory panel 34 is attached to one side of the base comforter 20. The view shown is of the bottom side of the base comforter 20 so that the buttons 30 are visible. Once the accessory panel 34 is attached, the comforter assembly 25 is turned over such that the buttons 30 are not shown.

FIG. 10 illustrates a configuration of the comforter assembly 25 with only a quarter segment 36 attached to one location to provide increased warmth at the bottom one side. In this configuration, one person's feet would have increased warmth, while the other sleeper would have the minimal warmth provided by the base comforter 20 alone.

FIG. 11 illustrates yet another example configuration of the example comforter assembly 25. In this configuration, both a ½ sized accessory panel 34 and a ¼ sized quarter segment 36 are attached by buttons 30 to the base comforter 20. In this configuration, the comforter assembly 25 adjusts warmth in the desired locations while leaving other parts with minimal warmth to suit each sleeper.

It should be understood that the configurations illustrated in FIGS. 9-11 are provided by way of example and are not an exhaustive treatment of all possibilities. More than one accessory panel 34 and/or quarter segment 36 may be attached at any one location to provide even more warmth. Moreover, different combinations of accessory panels 34 and quarter segments 36 could be utilized and are within the contemplation and scope of this disclosure.

Accordingly, the disclosed example comforter assembly 25 provides for tailoring of warmth to personal preference as well as seasonal changes such that only one comforter is all that is needed.

Although the different non-limiting embodiments are illustrated as having specific components or steps, the embodiments of this disclosure are not limited to those particular combinations. It is possible to use some of the components or features from any of the non-limiting embodiments in combination with features or components from any of the other non-limiting embodiments.

It should be understood that like reference numerals identify corresponding or similar elements throughout the several drawings. It should be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

Although an example embodiment has been disclosed, a worker of ordinary skill in this art would recognize that certain modifications would come within the scope of this disclosure. For that reason, the following claims should be studied to determine the scope and content of this disclosure.

What is claimed is:

1. An adjustable comforter comprising:

a one-piece base comforter including a top fabric layer attached to a bottom fabric layer and a plurality of filled cavities disposed between the top fabric layer and the bottom fabric layer, wherein the one-piece base comforter is of a size that includes a total width and a total length that define a periphery and the top fabric layer and the bottom fabric layer both extend uninterrupted entirely across the total width and the total length and the top fabric layer is attached to the bottom fabric layer about an entirety of the periphery of the one-piece base comforter;

a plurality of spaced apart fasteners attached to the one of the top fabric layer and the bottom fabric layer of the one-piece base comforter; and at least one accessory panel attachable to the one-piece base comforter with the plurality of spaced apart fasteners to provide an additional layer of the one-piece base comforter within the periphery of the one-piece base comforter.

2. The adjustable comforter as recited in claim 1, wherein the one-piece base comforter comprises one of a stich through or baffle box configuration.

3. The adjustable comforter as recited in claim 1, wherein the plurality of spaced apart fasteners comprises buttons attached to the bottom fabric layer.

4. The adjustable comforter as recited in claim 3, wherein the buttons are disposed at intervals about a periphery of the bottom fabric layer.

5. The adjustable comforter as recited in claim 4, wherein the plurality of buttons further includes buttons midway between a top edge, a bottom edge and side edges.

6. The adjustable comforter as recited in claim 5, wherein the at least one accessory panel includes a plurality of button holes disposed at locations corresponding to the plurality of buttons on the one-piece base comforter.

7. The adjustable comforter as recited in claim 1, wherein the at least one accessory panel is one half the total width of the one-piece base comforter and equal in total length to the one-piece base comforter.

8. The adjustable comforter as recited in claim 1, wherein the at least one accessory panel is quarter a size of the one-piece base comforter.

9. The adjustable comforter as recited in claim 1, wherein the at least one accessory panel has one of a sewn through or a baffle box configuration.

10. The adjustable comforter as recited in claim 1, wherein the one-piece base comforter includes a plurality of button holes and the plurality of spaced apart fasteners comprise a plurality of buttons.

11. The adjustable comforter as recited in claim 1, wherein the one-piece base comforter includes at least one loop disposed at a corner, the at least one loop configured for attachment to a cover.

12. The adjustable comforter as recited in claim 1, wherein the at least one accessory panel comprises a weighted panel.

13. An adjustable comforter comprising:

a one-piece base comforter having a top fabric layer attached to a bottom fabric layer, a plurality of microfiber filled cavities disposed between the top fabric layer and the bottom fabric layer and a plurality of buttons stitched to the bottom fabric layer, wherein the one-piece base comforter includes a size that includes a total width and a total length that define a periphery and the top fabric layer and the bottom fabric layer both extend uninterrupted entirely across the total width and the total length and the top fabric layer is attached to the bottom fabric layer about an entirety of the periphery of the one-piece base comforter; and at least one accessory panel having a plurality of button holes formed at locations corresponding to locations of the plurality of buttons on the one-piece base comforter to provide an additional layer on a bottom side of the one-piece base comforter within the periphery of the one-piece base comforter.

14. The adjustable comforter as recited in claim 13, wherein the at least one accessory panel is half the size of the one-piece base comforter.

15. The adjustable comforter as recited in claim 13, wherein the accessory panel is one quarter the size of the one-piece base comforter.

16. The adjustable comforter as recited in claim 13, wherein the one-piece base comforter further comprises a sewn through or baffle box construction that define the microfiber filled cavities.

17. The adjustable comforter as recited in claim 13, wherein the plurality of buttons are attached on the bottom fabric layer by stitches that extend through the top fabric layer.

18. A method of adjusting warmth of a comforter comprising:

providing a base comforter having a top fabric layer attached to a bottom fabric layer and a plurality of spaced apart fasteners disposed on the bottom fabric layer, wherein the base comforter is formed to includes a size having a total width and a total length that define a periphery and the top fabric layer and the bottom fabric layer both extend uninterrupted entirely across the total width and the total length and the top fabric layer is attached to the bottom fabric layer about the entire periphery of the base comforter; and attaching at least one accessory panel to the base comforter with the plurality of spaced apart fasteners on the bottom fabric layer of the base comforter to provide an additional layer on a bottom side of the base comforter within the periphery of the base comforter.

19. The method as recited in claim 18, wherein the plurality of spaced apart fasteners comprise buttons stitched to the bottom fabric layer and the at least one accessory panel includes button holes and attaching the at least one accessory panel comprising inserting the buttons through corresponding button holes.

20. The method as recited in claim 19, wherein the at least one accessory panel is one half or one quarter the size of the base comforter.

* * * * *